US012553448B1

(12) United States Patent
Chang et al.

(10) Patent No.: US 12,553,448 B1
(45) Date of Patent: Feb. 17, 2026

(54) IMPELLER WHEEL

(71) Applicant: DELTA ELECTRONICS, INC., Taoyuan (TW)

(72) Inventors: Shun-Chen Chang, Taoyuan (TW); Chin-Cheng Tsao, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 19/072,955

(22) Filed: Mar. 6, 2025

(30) Foreign Application Priority Data

Aug. 13, 2024 (CN) ..... 202411105956.8

(51) Int. Cl.
*F04D 29/28* (2006.01)
*F04D 17/06* (2006.01)
*F04D 29/66* (2006.01)

(52) U.S. Cl.
CPC ..... *F04D 29/281* (2013.01); *F04D 17/06* (2013.01); *F04D 29/662* (2013.01); *F04D 29/666* (2013.01)

(58) Field of Classification Search
CPC ..... F04D 29/281; F04D 17/06; F04D 29/384
See application file for complete search history.

(56) References Cited

U.S. PATENT DOCUMENTS

| | | | | |
|---|---|---|---|---|
| 8,007,240 | B2 * | 8/2011 | Sanagi | F04D 29/282 416/213 A |
| 10,001,144 | B2 * | 6/2018 | Shen | F04D 29/626 |
| 11,506,220 | B2 | 11/2022 | Gebert | |
| 2022/0099106 | A1 * | 3/2022 | Huang | F04D 17/16 |
| 2023/0124865 | A1 | 4/2023 | Heigold et al. | |

FOREIGN PATENT DOCUMENTS

| | | | |
|---|---|---|---|
| CN | 101825113 | B | 5/2013 |
| CN | 102192187 | B | 4/2016 |
| CN | 205806012 | U | 12/2016 |
| CN | 207363943 | U | 5/2018 |
| CN | 207513921 | U | 6/2018 |
| CN | 105090106 | B | 11/2020 |
| CN | 113738669 | A | 12/2021 |
| CN | 113738697 | A | 12/2021 |

* cited by examiner

*Primary Examiner* — Michael L Sehn
(74) *Attorney, Agent, or Firm* — CKC & Partners Co., LLC

(57) ABSTRACT

An impeller wheel includes a top ring, a bottom disc, and a plurality of fan blades. The inner edge of the top ring surrounds an air inlet. The top ring has a curved structure. The inner edge of the bottom disc surrounds an opening. The bottom disc has a curved structure. The fan blade has a front edge, a top edge, a rear edge, and a bottom edge. The top edge and the bottom edge are fixed to the top ring and the bottom disc, respectively. The top edge and the top ring define an upper connection line, and the bottom edge and the bottom disc define a lower connection line. When viewed from above, the upper and lower connection lines intersect, and a portion of the fan blade is joined with the upper and lower connection lines so as to form a contour line.

18 Claims, 5 Drawing Sheets

IMPELLER WHEEL

CROSS-REFERENCE TO RELATED APPLICATION

This application claims priority to China Application Serial Number 202411105956.8, filed Aug. 13, 2024, which is herein incorporated by reference.

BACKGROUND

Field of Invention

The present disclosure relates to an impeller wheel, and more particularly, to an impeller wheel having a three-dimensional twist feature.

Description of Related Art

Electronic devices usually generate heat during operation. If the heat is not removed efficiently, the electronic devices may crash easily, or in serious cases, electronic elements in the electronic devices may be burned, resulting in property damage. Conventional fan blades are arranged vertically, such as those found in centrifugal fans. A centrifugal fan operates by discharging air from a lateral air outlet after the air enters from an axial direction of the impeller.

Because network communication devices such as data centers have ever-increasing heat dissipation requirements, the application of axial-flow walls has been increasingly used. An industrial fan wall may include multiple axial-flow fans, but this is insufficient to solve the high heat-generation tendency of device elements, and it is still necessary to rely on centrifugal fans having higher wind pressure to provide sufficient heat dissipation efficiency.

SUMMARY

According to embodiments of the present disclosure, an impeller wheel includes a top ring, a bottom disc, and a plurality of fan blades disposed between the top ring and the bottom disc. The inner edge of the top ring surrounds to form an air inlet. The top ring has a curved structure between the inner edge and the outer edge of the top ring. The inner edge of the bottom disc surrounds to form an opening. The bottom disc has a curved structure between the inner edge and the outer edge of the bottom disc. The fan blade has a front edge, a top edge, a rear edge, and a bottom edge that are connected in this order. The top edge and the bottom edge of the fan blade are fixed to the top ring and the bottom disc, respectively. The top edge and the top ring of the fan blade define an upper connection line, and the bottom edge and the bottom disc of the fan blade define a lower connection line. From the top view of the impeller wheel, the upper connection line intersects the lower connection line, and a portion of the fan blade is joined with the upper connection line and the lower connection line so as to form a contour line.

In some embodiments of the present disclosure, from the top view, an angle between a tangent line of one end of the lower connection line connecting to the front edge and a tangent line of the front edge on the bottom disc is lower than 30 degrees.

In some embodiments of the present disclosure, the top ring and the bottom disc have a central axial line, a first angle between a connection line that is between two ends of the front edge and the central axial line is greater than a second angle between the rear edge and the central axial line.

In some embodiments of the present disclosure, the first angle is in a range from 30 to 70 degrees.

In some embodiments of the present disclosure, the second angle is in a range from 30 to 60 degrees.

In some embodiments of the present disclosure, the top ring and the bottom disc have a central axial line, and a distance between one end of the front edge on the top ring and the central axial line is greater than a distance between one end of the front edge on the bottom disc and the central axial line.

In some embodiments of the present disclosure, a distance between one end of the rear edge on the top ring and the central axial line is greater than a distance between one end of the rear edge on the bottom disc and the central axial line.

In some embodiments of the present disclosure, the top ring and the bottom disc have a plurality of positioning holes, the top edge and the bottom edge of each of the fan blades have a plurality of positioning protrusions, and the positioning protrusions are coupled to the positioning holes, respectively.

In some embodiments of the present disclosure, orthogonal projections of each of the fan blades on the bottom disc do not overlap with each other.

In some embodiments of the present disclosure, the outer edge of the top ring is a circle, and the outer edge of the top ring has a ring-shaped wall.

In some embodiments of the present disclosure, the impeller wheel further comprises at least one weight balance element located on the ring-shaped wall and the outer edge of the bottom disc.

In some embodiments of the present disclosure, the fan blades are solid metal sheets.

According to embodiments of the present disclosure, an impeller wheel includes a top ring, a bottom disc, and a plurality of fan blades disposed between the top ring and the bottom disc. The inner edge of the top ring surrounds to form an air inlet. The top ring has a curved structure between the inner edge and the outer edge of the top ring. The inner edge of the bottom disc surrounds to form an opening. The bottom disc has a curved structure between the inner edge and the outer edge of the bottom disc. The fan blade has a front edge, a top edge, a rear edge, and a bottom edge that are connected in this order. The top edge and the bottom edge of the fan blade are fixed to the top ring and the bottom disc, respectively. The top edge and the top ring of the fan blade define an upper connection line, and the bottom edge and the bottom disc of the fan blade define a lower connection line. From the top view of the impeller wheel, an angle between a tangent line of one end of the lower connection line connecting to the front edge and a tangent line of the front edge on the bottom disc is less than 30 degrees.

In some embodiments of the present disclosure, the top ring and the bottom disc have a central axial line, and a first angle between a connection line that is between two ends of the front edge and the central axial line is greater than a second angle between the rear edge and the central axial line.

In some embodiments of the present disclosure, the first angle is in a range from 30 degrees to 70 degrees.

In some embodiments of the present disclosure, the second angle is in a range from 30 degrees to 60 degrees.

In some embodiments of the present disclosure, wherein the top ring and the bottom disc have a central axial line, a distance between one end of the front edge on the top ring and the central axial line is greater than a distance between one end of the front edge on the bottom disc and the central axial line.

In some embodiments of the present disclosure, a distance between one end of the rear edge on the top ring and the central axial line is greater than a distance between one end of the rear edge on the bottom disc and the central axial line.

In some embodiments of the present disclosure, the top ring and the bottom disc have a plurality of positioning holes, the top edge and the bottom edge of each of fan blades have a plurality of positioning protrusions, and the positioning protrusions are coupled to the positioning holes, respectively.

In some embodiments of the present disclosure, orthogonal projections of each of the fan blades on the bottom disc do not overlap with each other.

In the above embodiments, since the top ring has a curved structure between the inner edge and outer edge thereof, the bottom disc has a curved structure between the inner edge and outer edge thereof, and the top edge and the bottom edge of the each of fan blades are fixed to the top ring and the bottom disc, respectively, the impeller wheel has the effect of a mixed-flow fan that is a side-flow centrifugal fan. Additionally, from the top view of the impeller wheel, the upper connection line defined by the top edge of the fan blades and the top ring and the lower connection line defined by the bottom edge of the fan blades and the bottom disc are intersected, and the portion of the fan blades is joined with the upper connection line and the lower connection line so as to form a contour line. As a result, the fan blades have a special three-dimensional twist feature that may combine the advantages of centrifugal fans and axial-flow fans to greatly improve the impeller wheel performance and the effect of wind pressure, such that the impeller wheel has excellent heat dissipation efficiency due to the increase in wind pressure.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
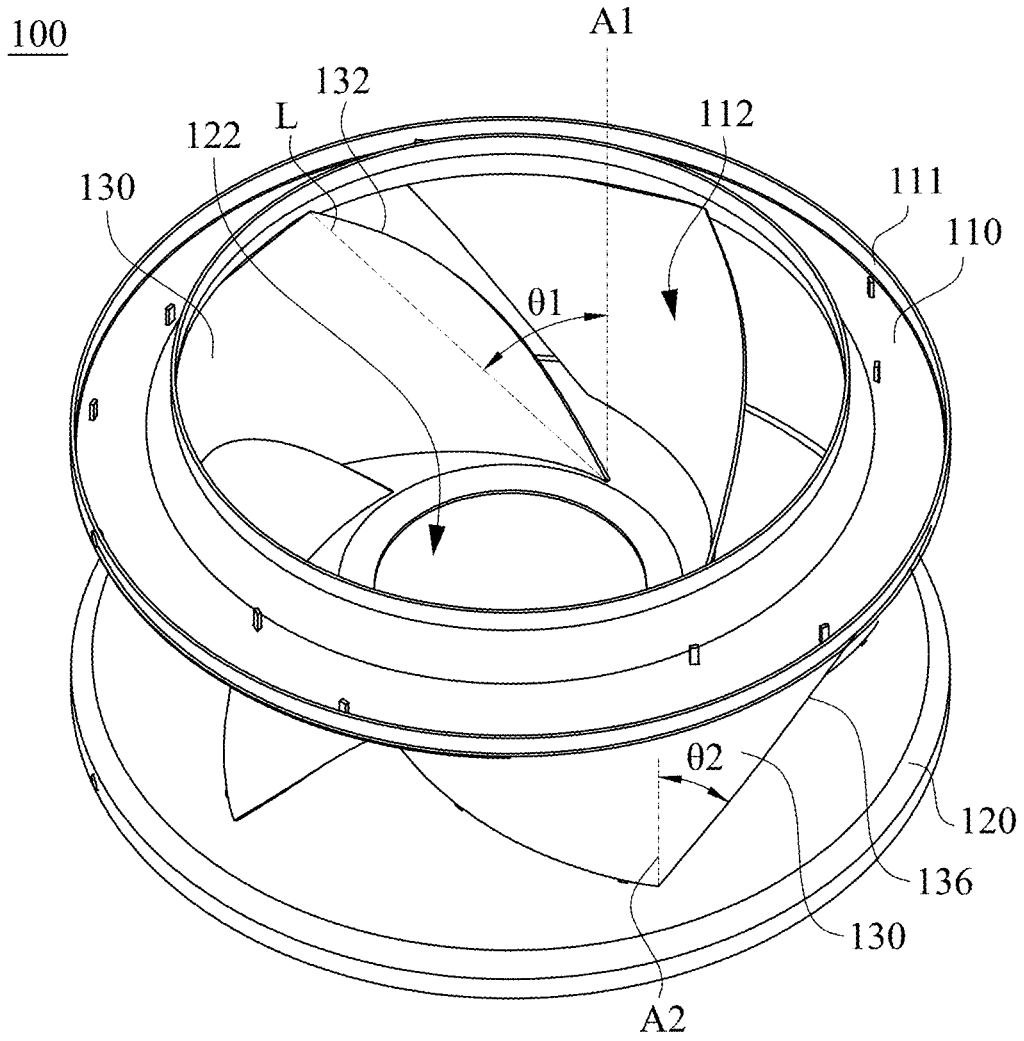
FIG. 1 is a perspective view of an impeller wheel according to one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "below," "lower," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
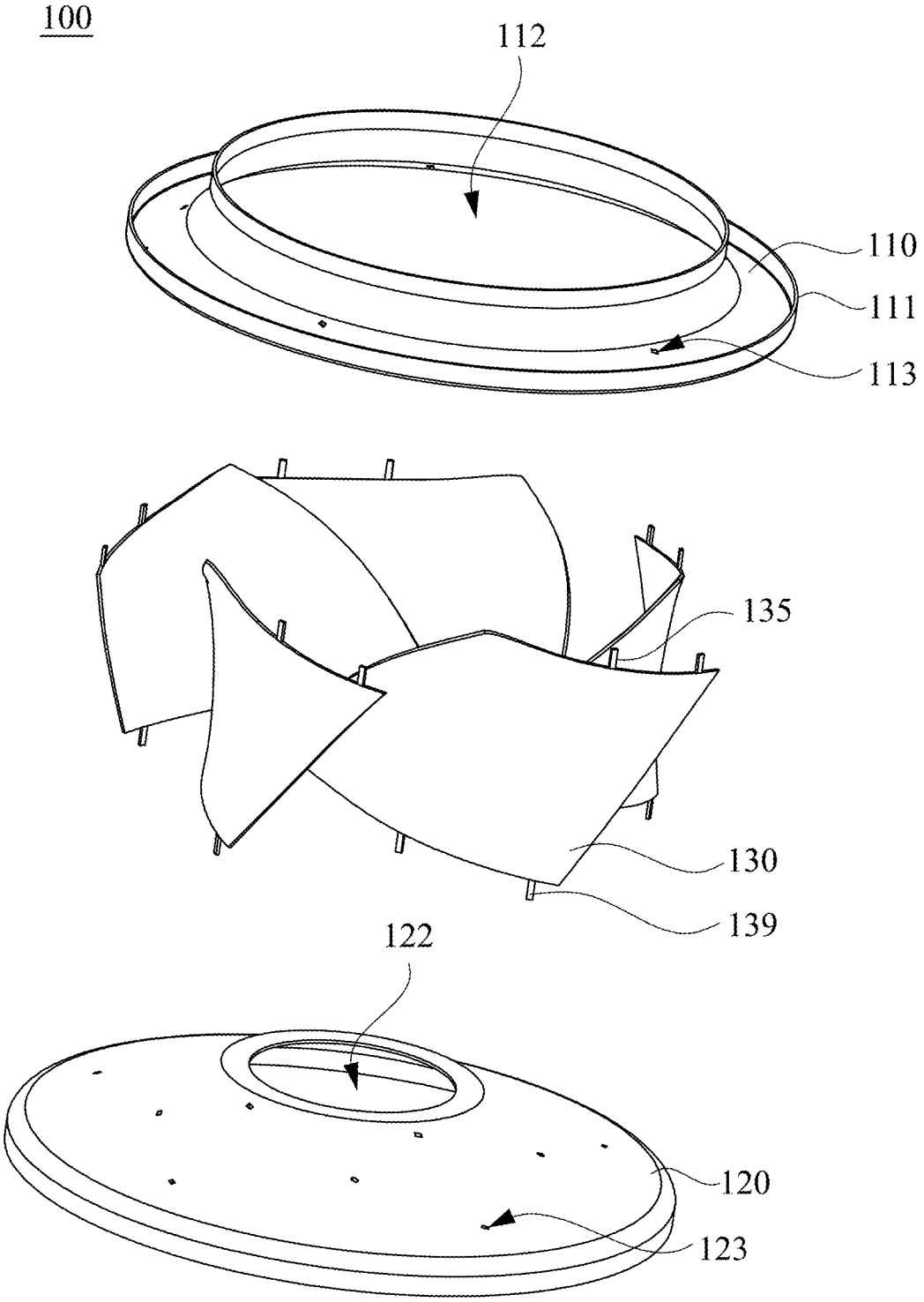
FIG. 2 is an exploded view of the impeller wheel of FIG. 1.

FIG. 1 is a perspective view of an impeller wheel according to one embodiment of the present disclosure. FIG. 2 is an exploded view of the impeller wheel of FIG. 1. As shown in FIG. 1 and FIG. 2, the impeller wheel 100 includes a top ring 110, a bottom disc 120 and a plurality of fan blades 130 disposed between the top ring 110 and the bottom disc 120. An inner edge of the top ring 110 surrounds to form an air inlet 112, and the top ring 110 has a curved structure between the inner edge and an outer edge of the top ring 110. That is, the outer edge and the inner edge of the top ring 110 are located on different levels. In this embodiment, the outer edge of the top ring 110 is a circle. The bottom disc 120 is located below the top ring 110. An inner edge of the bottom disc 120 surrounds an opening 122 for connecting to a driving device, such as a motor. In general, the opening 122 is used to connect with a hub of a motor rotor. The bottom disc 120 has a curved structure between the inner edge and an outer edge of the bottom disc 120, and the outer edge of the bottom disc 120 is lower than the inner edge of the bottom disc 120 relative to a horizontal plane. Each of the fan blades 130 are connected to the top ring 110 and the bottom disc 120, respectively. During operation, the bottom disc 120 is driven by the driving device to rotate, and the fan blades 130 and the top ring 110 rotate synchronously. Air flow may enter from the air inlet 112 of the inner edge of the top ring 110 of the impeller wheel 100, and flows out along two sides of the fan blades 130 and a top surface of the bottom disc 120.

Figure 3:
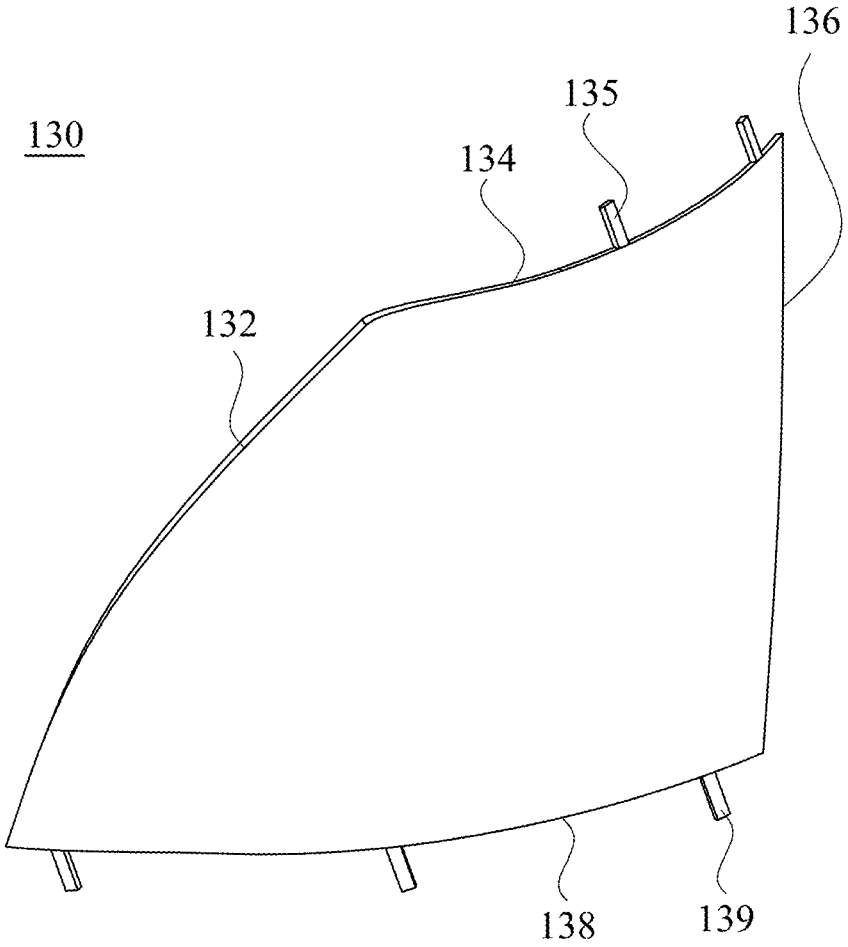
FIG. 3 is a perspective view of a fan blade of FIG. 2.

FIG. 3 is a perspective view of the fan blade 130 of FIG. 2. As shown in FIG. 1 and FIG. 3, each of the fan blades 130 has a front edge 132, a top edge 134, a rear edge 136, and a bottom edge 138 that are connected in this order, and the top edge 134 and the bottom edge 138 of the fan blade 130 are fixed to the top ring 110 and the bottom disc 120, respectively. The front edge 132 of the fan blade 130 is close to an inner side of the fan blade 130, and the rear edge 136 of the fan blade 130 is close to an outer side of the fan blade 130. In this embodiment, all the fan blades 130 are solid metal sheets, and have a special three-dimensional twist feature that will be explained in detail with reference to FIG. 4 to FIG. 6.

Referring to FIG. 1, in order to clearly indicate a first angle θ1 and a second angle θ2 shown in FIG. 1, a central axial line of the top ring 110 and the bottom disc 120 is horizontally moved to central axial lines A1, A2. That is to say, the central axial lines A1, A2 may be regarded as projected positions of the central axial line of the top ring 110 and the bottom disc 120. The central axial lines A1, A2 and a rotation axial line of the impeller wheel 100 are in the same direction. The first angle θ1 is between the central axial line A1 and a connection line L that is between two ends of the front edge 132 of the fan blades 130, the second angle θ2 is between the rear edge 136 of the fan blade 130 and the central axial line A2, and the first angle θ1 is greater than the second angle θ2. In some embodiments, the first angle θ1 is in a range from 30 to 70 degrees, and the second angle θ2 is in a range from 30 to 60 degrees.

Referring to FIG. 2 and FIG. 3, the top ring 110 of the impeller wheel 100 has a plurality of positioning holes 113, and the bottom disc 120 has a plurality of positioning holes 123. In addition, the top edge 134 of the fan blade 130 has a plurality of positioning protrusions 135, and the bottom edge 138 has a plurality of positioning protrusions 139. During assembly, the positioning protrusions 135 of the top edge 134 of the fan blade 130 may be coupled to the positioning holes 113 of the top ring 110, and the positioning protrusions 139 of the bottom edge 138 of the fan blade 130 may be coupled to the positioning holes 113 of the bottom disc 120. As a result, the fan blade 130 may be positioned between the top ring 110 and the bottom disc 120. In some embodiments, the positioning protrusions 135 and 139 may be fixed to the top ring 110 and the bottom disc 120, respectively, by welding or welding with crimping.

Figure 4:
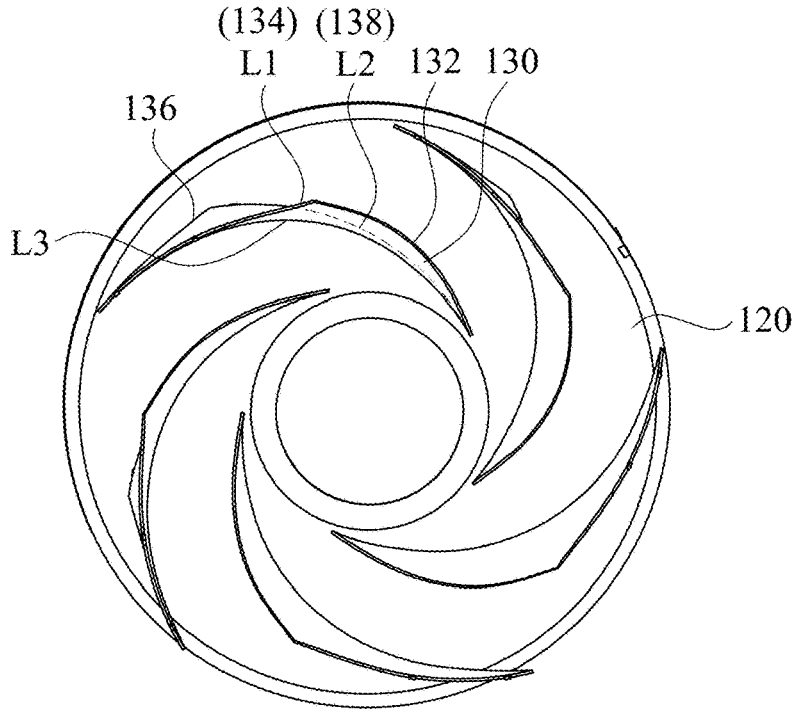
FIG. 4 is a top view of the impeller wheel excluding a top ring of FIG. 1.
Figure 5:
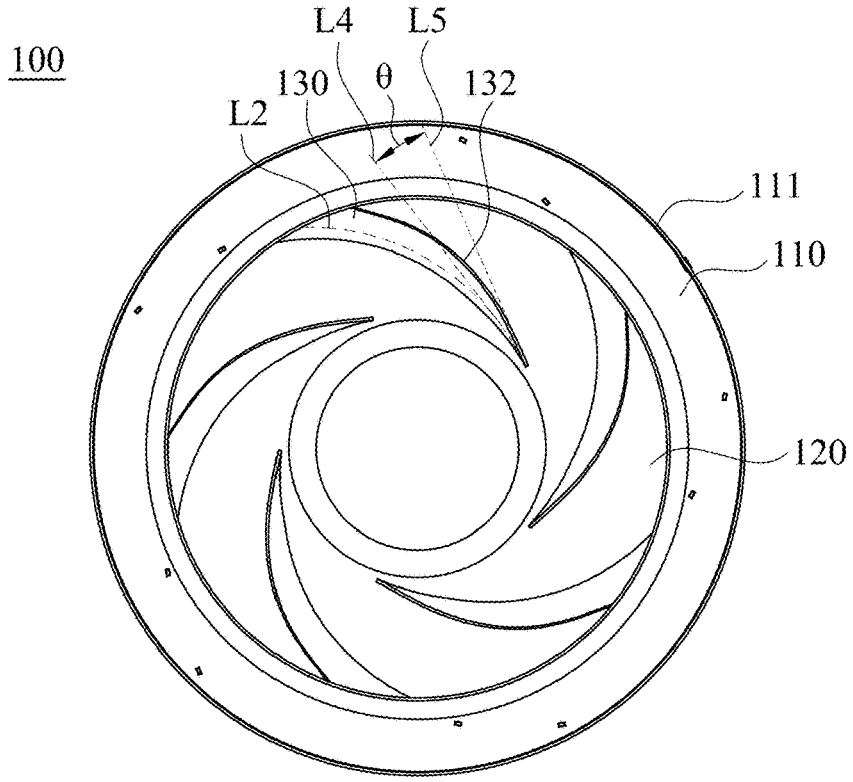
FIG. 5 is a top view of the impeller wheel of FIG. 1.

FIG. 4 is a top view of the impeller wheel 100 excluding the top ring 110 of FIG. 1. FIG. 5 is a top view of the impeller wheel 100 of FIG. 1. As shown in FIG. 4 and FIG. 5, the top edge 134 of the fan blade 130 and the top ring 110 define an upper connection line L1, and the bottom edge 138 of the fan blade 130 and the bottom disc 120 define a lower connection line L2. From the top view of the impeller wheel 100, a viewing angle of FIG. 4 in which a line of sight is an axis direction, the upper connection line L1 intersects the lower connection line L2, and a portion of each of the fan blades 130 is joined with the upper connection line L1 and the lower connection line L2 so as to form a contour line L3. For example, two ends of the contour line L3 shown in FIG. 4 extend to the upper connection line L1 and the lower connection line L2, respectively, and the exposed contour line L3 does not overlap the upper connection line L1 and the lower connection line L2. In this embodiment, the number of the fan blades 130 is five, but the present disclosure is not limited thereto. In addition, orthogonal projections of each of the fan blades 130 on the bottom disc 120 do not overlap with each other.

By the above configurations, the fan blades 130 may have a special three-dimensional twist feature. The design described above may combine advantages of centrifugal fans and axial-flow fans so as to improve greatly performance of the impeller wheel 100, and to have effects of increasing wind pressure and noise reduction such that the impeller wheel 100 has excellent heat dissipation efficiency. In addition, the impeller wheel 100 may further combine use of static blades so as to increase secondary pressure, thereby facilitating further system application upgrade.

Referring to FIG. 3 and FIG. 5, from the top view of the impeller wheel 100, the line of sight is in the axis direction, one end of the lower connection line L2 defined by the bottom edge 138 of the fan blade 130 and the bottom disc 120 connects to the front edge 132 of the fan blade 130, and the end of the lower connection line L2 has a tangent line L4. Moreover, an angle θ is between the tangent line L4 and a tangent line L5 of the front edge 132 of the fan blade 130 on the bottom disc 120, and the angle θ is less than 30 degrees. The design described above may make the fan blades 130 have a special three-dimensional twist feature, and have effects of increasing wind pressure and noise reduction such that the impeller wheel 100 has excellent heat dissipation efficiency.

Figure 6:
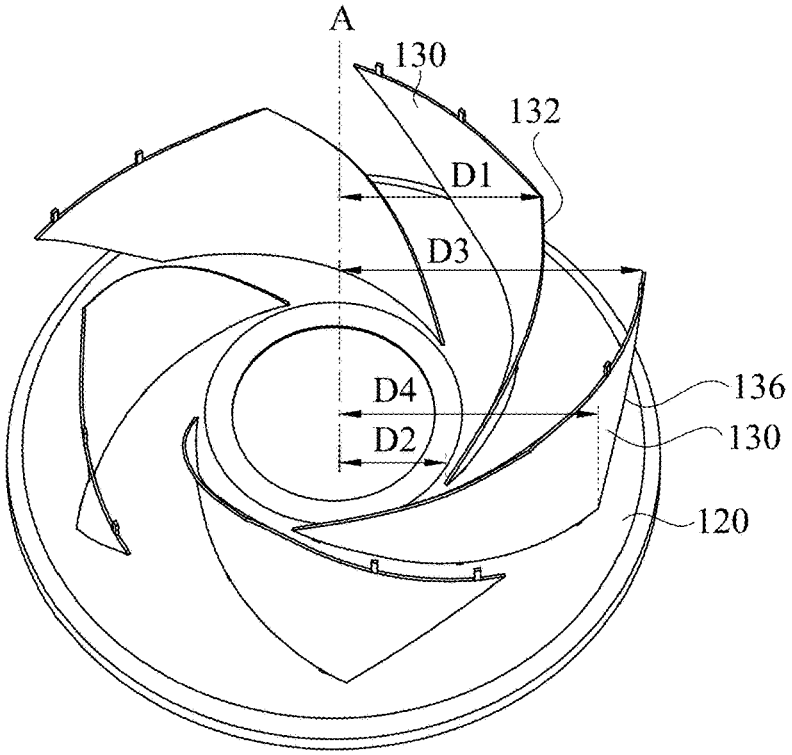
FIG. 6 is a perspective view of the impeller wheel excluding a top ring of FIG. 1.

FIG. 6 is a perspective view of the impeller wheel 100 excluding the top ring 110 of FIG. 1. As shown in FIG. 1 and FIG. 6, the top ring 110 and the bottom disc 120 have a central axial line A. A distance D1 is between one end of the front edge 132 of the fan blade 130 on the top ring 110 and the central axial line A, a distance D2 is between one end of the front edge 132 on the bottom disc 120 and the central axial line A, and the distance D1 is greater than the distance D2. In addition, a distance D3 is between one end of the rear edge 136 of the fan blade 130 on the top ring 110 and the central axial line A, a distance D4 is between one end of the rear edge 136 on the bottom disc 120 and the central axial line A, and the distance D3 is greater than the distance D4. The central axial line may be seen as a rotation axial line of the impeller wheel 100. The design described above may make the fan blades 130 have a special three-dimensional twist feature and have effects of increasing wind pressure and noise reduction such that the impeller wheel 100 has excellent heat dissipation efficiency.

Figure 7:
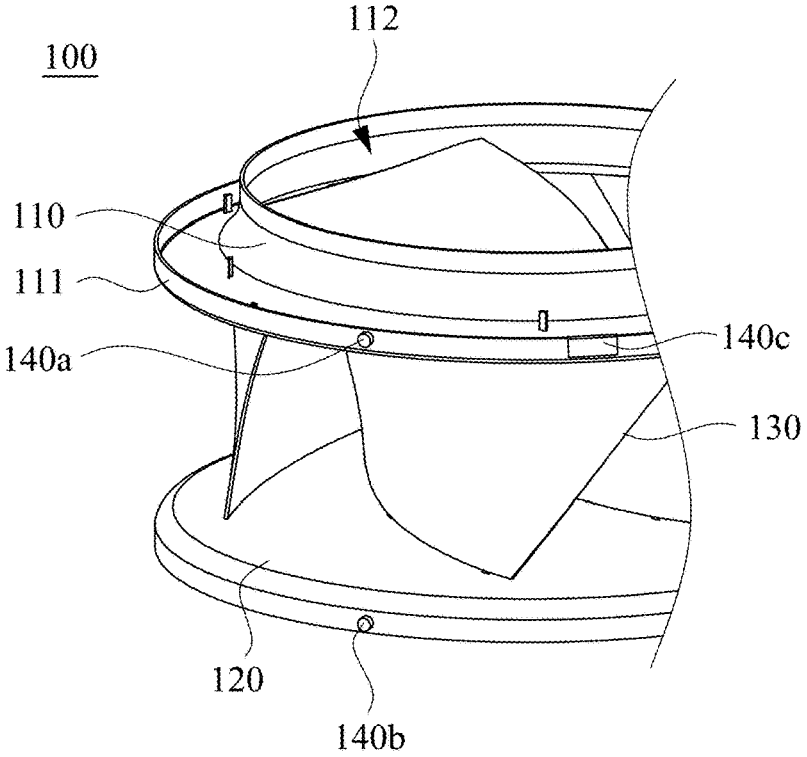
FIG. 7 is a side view of the impeller wheel of FIG. 1.

FIG. 7 is a side view of the impeller wheel 100 of FIG. 1. As shown in FIG. 7, the outer edge of the top ring 110 of the impeller wheel 100 extends in the axial direction to form a ring-shaped wall 111. The impeller wheel 100 may further optionally include weight balance elements 140*a*, 140*b*, and 140*c* to maintain rotational balance of the impeller wheel 100. The weight balance elements 140*a*, 140*c* are located on the ring-shaped wall 111 of the top ring 110, and the weight balance elements 140*b* are located on the outer edge of the bottom disc 120. In some embodiments, the weight balance elements 140*a*, 140*b* are, for example, rivets, and the fan blades 130 may be balanced by riveting. The weight balance elements 140*c* are, for example, clips that may be clamped on the ring-shaped wall 111 of the top ring 110.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An impeller wheel, comprising:

a top ring, wherein an inner edge of the top ring surrounds an air inlet, and the top ring has a curved structure between the inner edge and an outer edge of the top ring, and the outer edge of the top ring is a circle and has a ring-shaped wall;

a bottom disc, wherein an inner edge of the bottom disc surrounds an opening, and the bottom disc has a curved structure between the inner edge and an outer edge of the bottom disc;

a plurality of fan blades connecting to the top ring and the bottom disc, wherein each of the fan blades has a front edge, a top edge, a rear edge, and a bottom edge that are connected in this order, the top edge and the bottom edge are fixed to the top ring and the bottom disc, respectively, the top edge and the top ring define an upper connection line, the bottom edge and the bottom disc define a lower connection line, the upper connection line intersects the lower connection line when viewed from above, and a portion of each of the fan blades is joined with the upper connection line and the lower connection line so as to form a contour line; and at least one weight balance element located on the ring-shaped wall and the outer edge of the bottom disc.

2. The impeller wheel of claim 1, wherein from a top view of the impeller wheel, an angle between a tangent line of one end of the lower connection line connecting to the front edge and a tangent line of the front edge on the bottom disc is less than 30 degrees.

3. The impeller wheel of claim 1, wherein the top ring and the bottom disc have a central axial line, a first angle between a connection line that is between two ends of the front edge and the central axial line is greater than a second angle between the rear edge and the central axial line.

4. The impeller wheel of claim 3, wherein the first angle is in a range from 30 degrees to 70 degrees.

5. The impeller wheel of claim 3, wherein the second angle is in a range from 30 degrees to 60 degrees.

6. The impeller wheel of claim 1, wherein the top ring and the bottom disc have a central axial line, and a distance between one end of the front edge on the top ring and the central axial line is greater than a distance between one end of the front edge on the bottom disc and the central axial line.

7. The impeller wheel of claim 6, wherein a distance between one end of the rear edge on the top ring and the central axial line is greater than a distance between one end of the rear edge on the bottom disc and the central axial line.

8. The impeller wheel of claim 1, wherein the top ring and the bottom disc have a plurality of positioning holes, the top edge and the bottom edge of each of the fan blades have a plurality of positioning protrusions, and the positioning protrusions are coupled to the positioning holes, respectively.

9. The impeller wheel of claim 1, wherein orthogonal projections of each of the fan blades on the bottom disc do not overlap with each other.

10. The impeller wheel of claim 1, wherein the fan blades are solid metal sheets.

11. An impeller wheel, comprising:

a top ring, wherein an inner edge of the top ring surrounds an air inlet, and the top ring has a curved structure between the inner edge and an outer edge of the top ring, and the outer edge of the top ring is a circle and has a ring-shaped wall;

a bottom disc, wherein the inner edge of the bottom disc surrounds an opening, and the bottom disc has a curved structure between the inner edge and an outer edge of the bottom disc; and a plurality of fan blades connecting to the top ring and the bottom disc, wherein each of the fan blades has a front edge, a top edge, a rear edge, and a bottom edge that are connected in this order, the top edge and the bottom edge are respectively fixed to the top ring and the bottom disc, the top edge and the top ring define an upper connection line, the bottom edge and the bottom disc define a lower connection line, and when viewed from above, an angle between a tangent line of one end of the lower connection line connecting to the front edge and a tangent line of the front edge on the bottom disc is less than 30 degrees; and at least one weight balance element located on the ring-shaped wall and the outer edge of the bottom disc.

12. The impeller wheel of claim 11, wherein the top ring and the bottom disc have a central axial line, and a first angle between a connection line that is between two ends of the front edge and the central axial line is greater than a second angle between the rear edge and the central axial line.

13. The impeller wheel of claim 12, wherein the first angle is in a range from 30 degrees to 70 degrees.

14. The impeller wheel of claim 12, wherein the second angle is in a range from 30 degrees to 60 degrees.

15. The impeller wheel of claim 11, wherein the top ring and the bottom disc have a central axial line, a distance between one end of the front edge on the top ring and the central axial line is greater than a distance between one end of the front edge on the bottom disc and the central axial line.

16. The impeller wheel of claim 15, wherein a distance between one end of the rear edge on the top ring and the central axial line is greater than a distance between one end of the rear edge on the bottom disc and the central axial line.

17. The impeller wheel of claim 11, wherein the top ring and the bottom disc have a plurality of positioning holes, the top edge and the bottom edge of each of fan blades have a plurality of positioning protrusions, and the positioning protrusions are coupled to the positioning holes, respectively.

18. The impeller wheel of claim 11, wherein orthogonal projections of each of the fan blades on the bottom disc do not overlap with each other.

* * * * *